US009664369B2

(12) United States Patent
Richards et al.

(10) Patent No.: US 9,664,369 B2
(45) Date of Patent: May 30, 2017

(54) LED LAMP

(71) Applicant: Cree, Inc., Durham, NC (US)

(72) Inventors: Charles Richards, Cary, NC (US); Shawn Keeney, Chapel Hill, NC (US); Mark Youmans, Goleta, CA (US); Michael Leung, Ventura, CA (US); Nicholas Desilva, Four Oaks, NC (US); Dante Nava, Cary, NC (US); Robert Higley, Cary, NC (US)

(73) Assignee: Cree, Inc., Durham, NC (US)

( * ) Notice: Subject to any disclaimer, the term of this patent is extended or adjusted under 35 U.S.C. 154(b) by 77 days.

(21) Appl. No.: 14/207,847

(22) Filed: Mar. 13, 2014

(65) Prior Publication Data

US 2014/0268772 A1 Sep. 18, 2014

Related U.S. Application Data

(60) Provisional application No. 61/778,971, filed on Mar. 13, 2013.

(51) Int. Cl.

| | |
|---|---|
| ***F21K 99/00*** | (2016.01) |
| ***F21V 29/00*** | (2015.01) |
| ***F21V 29/70*** | (2015.01) |
| ***F21K 9/232*** | (2016.01) |
| *F21V 3/00* | (2015.01) |

(Continued)

(52) U.S. Cl.

CPC ..... *F21V 29/70* (2015.01); *F21K 9/232* (2016.08); *F21V 3/00* (2013.01); *F21V 29/004* (2013.01); *F21Y 2107/00* (2016.08); *F21Y 2115/10* (2016.08)

(58) Field of Classification Search

CPC ..... F21K 9/135; F21V 29/70

See application file for complete search history.

(56) References Cited

U.S. PATENT DOCUMENTS

| | | | |
|---|---|---|---|
| 3,581,162 | A | 5/1971 | Wheatley |
| 5,463,280 | A | 10/1995 | Johnson |
| 5,561,346 | A | 10/1996 | Byrne |

(Continued)

FOREIGN PATENT DOCUMENTS

| | | | |
|---|---|---|---|
| EP | 1058221 | A2 | 12/2000 |
| EP | 0890059 | B1 | 6/2004 |

(Continued)

*Primary Examiner* — Jong-Suk (James) Lee
*Assistant Examiner* — Eric T Eide
(74) *Attorney, Agent, or Firm* — Dennis J. Williamson; Moore & Van Allen PLLC

(57) ABSTRACT

A LED lamp has a base and an at least partially optically transmissive enclosure connected to the base. A heat sink is partially disposed in the enclosure and supports a plurality of LEDs. The heat sink comprising a mounting portion positioned in the enclosure for supporting the LEDs and a heat dissipating portion exposed to the ambient environment where the interior of the enclosure is exposed to the ambient environment. The heat sink have a plurality of separate heat sink structures that are mounted to the lamp independently of one another. Each heat sink structure may have a thickness of approximately 1-5 mm. Each heat sink structure may in some embodiments weigh approximately 3.8 to 7.7 grams and in other embodiments weigh approximately 27 grams.

16 Claims, 6 Drawing Sheets

(51) Int. Cl.
*F21Y 115/10* (2016.01)
*F21Y 107/00* (2016.01)

(56) References Cited

U.S. PATENT DOCUMENTS 5,585,783 A 12/1996 Hall
5,655,830 A 8/1997 Ruskouski
5,688,042 A 11/1997 Madadi et al.
5,806,965 A 9/1998 Deese
5,947,588 A 9/1999 Huang
5,949,347 A 9/1999 Wu
6,220,722 B1 4/2001 Begemann
6,227,679 B1 5/2001 Zhang et al.
6,234,648 B1 5/2001 Borner et al.
6,250,774 B1 6/2001 Begemann et al.
6,276,822 B1 8/2001 Bedrosian et al.
6,465,961 B1 10/2002 Cao
6,523,978 B1 2/2003 Huang
6,550,953 B1 4/2003 Takahashi et al.
6,634,770 B2 10/2003 Cao
6,659,632 B2 12/2003 Chen
6,709,132 B2 3/2004 Ishibashi
6,803,607 B1 10/2004 Chan et al.
6,848,819 B1 2/2005 Arndt et al.
6,864,513 B2 3/2005 Lin et al.
6,948,829 B2 9/2005 Verdes et al.
6,982,518 B2 1/2006 Chou et al.
7,048,412 B2 5/2006 Martin et al.
7,080,924 B2 7/2006 Tseng et al.
7,086,756 B2 8/2006 Maxik
7,086,767 B2 8/2006 Sidwell et al.
7,144,135 B2 12/2006 Martin et al.
7,165,866 B2 1/2007 Li
7,172,314 B2 2/2007 Currie et al.
7,213,940 B1 5/2007 Van De Ven et al.
7,354,174 B1 4/2008 Yan
7,396,142 B2 7/2008 Laizure, Jr. et al.
7,600,882 B1 10/2009 Morejon et al.
7,726,836 B2 6/2010 Chen
7,824,065 B2 11/2010 Maxik
7,965,023 B1 6/2011 Liang
8,021,025 B2 9/2011 Lee
8,253,316 B2 8/2012 Sun et al.
8,272,762 B2 9/2012 Maxik et al.
8,274,241 B2 9/2012 Guest et al.
8,277,082 B2 10/2012 Dassanayake et al.
8,282,249 B2 10/2012 Liang et al.
8,282,250 B1 10/2012 Dassanayake et al.
8,292,468 B2 10/2012 Narendran et al.
8,322,896 B2 12/2012 Falicoff et al.
8,371,722 B2 2/2013 Carroll
8,400,051 B2 3/2013 Hakata et al.
8,415,865 B2 4/2013 Liang et al.
8,421,320 B2 4/2013 Chuang
8,421,321 B2 4/2013 Chuang
8,421,322 B2 4/2013 Carroll et al.
8,421,329 B2 4/2013 Liang et al.
8,427,037 B2 4/2013 Liang et al.
8,449,154 B2 5/2013 Uemoto et al.
8,502,468 B2 8/2013 Li et al.
8,556,465 B2 10/2013 Lee et al.
8,641,237 B2 2/2014 Chuang
8,653,723 B2 2/2014 Cao et al.
8,696,168 B2 4/2014 Li et al.
8,740,415 B2 6/2014 Wheelock
8,750,671 B1 6/2014 Kelly et al.
8,752,984 B2 6/2014 Lenk et al.
8,760,042 B2 6/2014 Sakai et al.
2004/0201990 A1 10/2004 Meyer
2009/0184618 A1 7/2009 Hakata et al.
2009/0310340 A1* 12/2009 Betz ..... F24C 7/105 362/183
2010/0314985 A1* 12/2010 Premysler ..... F21K 9/56 313/46
2011/0089838 A1* 4/2011 Pickard ..... F21V 29/767 315/113
2011/0273102 A1 11/2011 Van De Ven et al.
2012/0040585 A1 2/2012 Huang
2012/0268936 A1* 10/2012 Pickard ..... F21K 9/135 362/249.02
2013/0026923 A1 1/2013 Athalye et al.
2013/0026925 A1 1/2013 Ven et al.
2013/0069535 A1 3/2013 Athalye
2013/0069547 A1 3/2013 Van De Ven et al.
2013/0162149 A1 6/2013 Van De Ven et al.
2013/0162153 A1 6/2013 Van De Ven et al.
2013/0169159 A1 7/2013 Lys
2013/0293135 A1 11/2013 Hu et al.
2013/0294068 A1* 11/2013 Kuenzler ..... F21V 7/048 362/234
2014/0085908 A1* 3/2014 Wu ..... F21K 9/1355 362/373

FOREIGN PATENT DOCUMENTS

GB 2345954 A 7/2000
JP H09265807 A 10/1997
JP 2000173304 A 6/2000
JP 2001118403 A 4/2001
JP 2007059930 A 3/2007
JP 2008288183 A 11/2008
JP 2009117346 A 5/2009
JP 3153766 U 9/2009
JP 2009277586 A 11/2009
WO 0124583 A1 4/2001
WO 0160119 A2 8/2001
WO 2012011279 A1 1/2012
WO 2012031533 A1 3/2012

* cited by examiner

LED LAMP

This application claims benefit of priority under 35 U.S.C. §119(e) to the filing date of U.S. Provisional Application No. 61/778,971, as filed on Mar. 13, 2013, which is incorporated herein by reference in its entirety.

BACKGROUND

Light emitting diode (LED) lighting systems are becoming more prevalent as replacements for older lighting systems. LED systems are an example of solid state lighting (SSL) and have advantages over traditional lighting solutions such as incandescent and fluorescent lighting because they use less energy, are more durable, operate longer, can be combined in multi-color arrays that can be controlled to deliver virtually any color light, and generally contain no lead or mercury. A solid-state lighting system may take the form of a lighting unit, light fixture, light bulb, or a "lamp."

An LED lighting system may include, for example, a packaged light emitting device including one or more light emitting diodes (LEDs), which may include inorganic LEDs, which may include semiconductor layers forming p-n junctions and/or organic LEDs, which may include organic light emission layers. Light perceived as white or near-white may be generated by a combination of red, green, and blue ("RGB") LEDs. Output color of such a device may be altered by separately adjusting supply of current to the red, green, and blue LEDs. Another method for generating white or near-white light is by using a lumiphor such as a phosphor. Still another approach for producing white light is to stimulate phosphors or dyes of multiple colors with an LED source. Many other approaches can be taken.

An LED lamp may be made with a form factor that allows it to replace a standard incandescent bulb, or any of various types of fluorescent lamps. LED lamps often include some type of optical element or elements to allow for localized mixing of colors, collimate light, or provide a particular light pattern. Sometimes the optical element also serves as an envelope or enclosure for the electronics and or the LEDs in the lamp.

Since, ideally, an LED lamp designed as a replacement for a traditional incandescent or fluorescent light source needs to be self-contained; a power supply is included in the lamp structure along with the LEDs or LED packages and the optical components. A heatsink is also often needed to cool the LEDs and/or power supply in order to maintain appropriate operating temperature.

SUMMARY OF THE INVENTION

In one embodiment a LED lamp comprises a base and an at least partially optically transmissive enclosure connected to the base. A heat sink is partially disposed in the enclosure and supports a plurality of LEDs operable to emit light when energized. The heat sink comprising a mounting portion positioned in the enclosure for supporting the LEDs and a heat dissipating portion exposed to the ambient environment where the interior of the enclosure is exposed to the ambient environment.

The lamp may have a lumen output of approximately at least 1600 lumens in a steady state operation. The lamp may have a color rendering index of approximately at least 80 with a correlated color temperature (CCT) of less than approximately 3000. The lamp may have an efficiency of at least approximately 80 lumens per Watt (LPW). The base may comprise an Edison base. The LEDs may be mounted on a thermally conductive submount. The LEDs may surround a longitudinal axis of the lamp and may emit light generally toward the enclosure. The submount may comprise at least one of a PCB, metal core printed circuit board, FR4 board, lead frame or flex circuit. The submount may be folded into a three-dimensional shape. The at least one submount may have a thickness of about 0.25 mm-2.0 mm thick. The submounts may have a surface area of approximately 20 square mm. The lamp may have a total power of approximately 21 Watts and the junction temperature of the plurality of LEDs may be between approximately 105 and 111° C. Lamp electronics in the electrical path may be contained in a housing comprising a first portion that is connected to the base and a second portion that extends into the heat sink. The enclosure may comprise a first portion comprising an optically tranmissive material and a second portion comprising openings that communicate the interior of the enclosure with the exterior of the lamp. The heat sink may comprise a plurality of separate heat sink structures that are mounted to the lamp independently of one another. Each heat sink structure may support at least one LED. Passages may be formed between and behind the adjacent heat sink structures that allow air to circulate from the ambient environment around the heat sink. Each heat sink structure may comprise one or more mounting surfaces for mounting the submounts such that the submounts are thermally coupled to the heat sink. The heat sink structures may comprise a fin structure that is located in the openings. The mounting surfaces may be disposed on the heat sink at an angle other than 90 degrees relative to the longitudinal axis of the lamp. Each of the plurality of heat sink structures may comprise a fin structure that is exposed to the exterior of the lamp. Each of the plurality of heat sink structures may have a thickness of approximately 3-5 mm. Each of the plurality of heat sink structures may weigh between approximately 20 and 35 grams. The heat sink may have a total weight of approximately 110 to 170 grams. Each of the plurality of heat sink structures may have a thickness of approximately 1 to 3 mm. Each of the plurality of heat sink structures may weigh approximately 3.8 to 10.0 grams. The heat sink may have a total weight of approximately 15 to 50 grams.

In some embodiments a LED lamp comprises a base and an at least partially optically transmissive enclosure connected to the base. A heat sink is partially disposed in the enclosure and supports a plurality of LEDs operable to emit light when energized. The heat sink comprises an interior space and a mounting portion positioned in the enclosure for supporting the LEDs and a heat dissipating portion exposed to the ambient environment where the mounting portion and the interior space are exposed to the ambient environment.

In some embodiments, a LED lamp comprises a base and an at least partially optically transmissive enclosure having an interior and connected to the base. A heat sink is partially disposed in the enclosure and supports a plurality of LEDs operable to emit light when energized. The heat sink comprises an interior space and a mounting portion positioned in the enclosure for supporting the LEDs where the interior space communicates the interior of the enclosure to the ambient environment.

In some embodiments a LED lamp comprises a base and an at least partially optically transmissive enclosure connected to the base. A heat sink is partially disposed in the enclosure and supports a plurality of LEDs operable to emit light when energized. A portion of the heat sink is positioned between the enclosure and the base where a portion of the heat sink is exposed to an exterior of the lamp where the portion of the heat sink comprises openings.

DETAILED DESCRIPTION OF EMBODIMENTS OF THE INVENTION

Figures 1, 2:
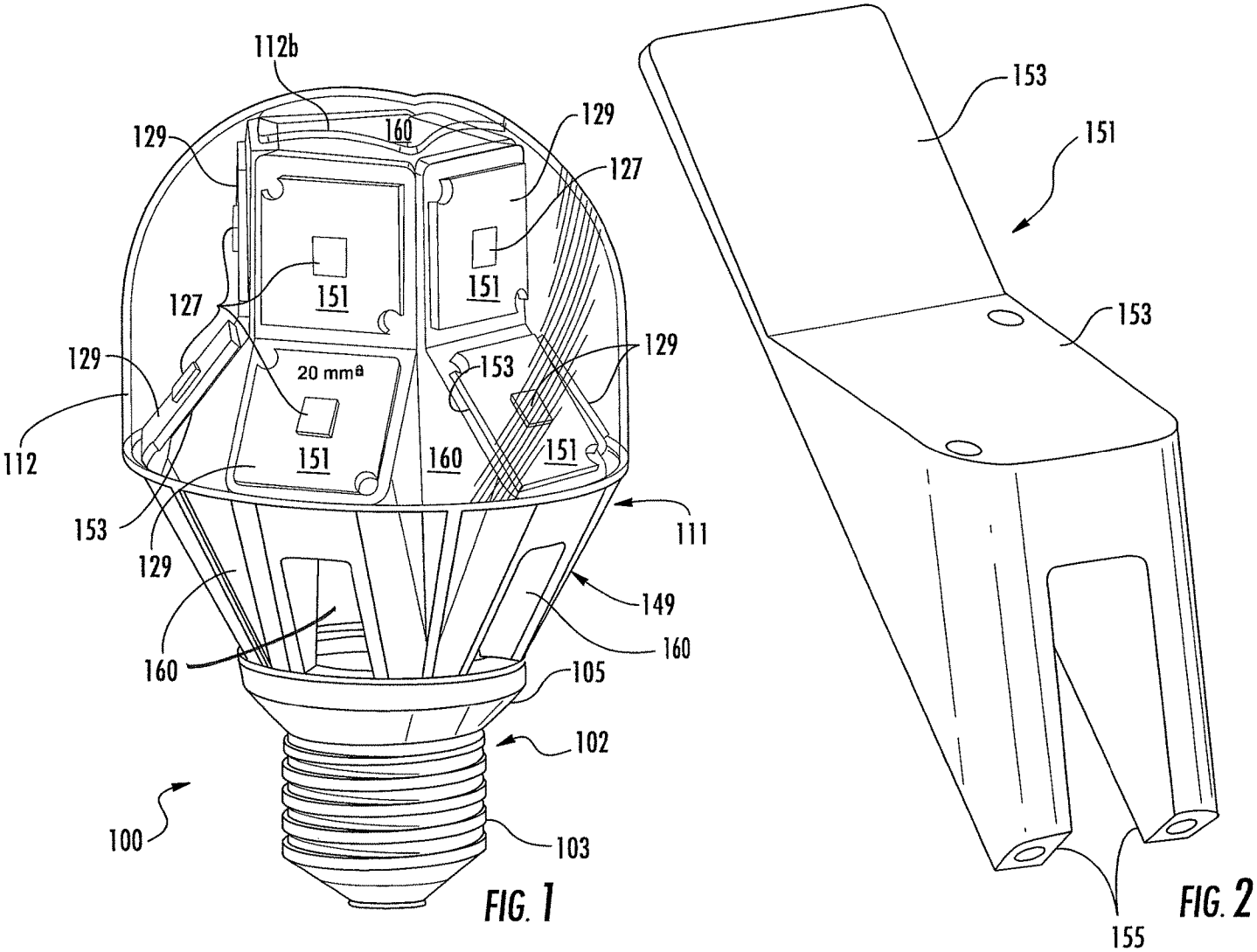
FIG. 1 is a perspective view of an embodiment of the lamp of the invention.
FIG. 2 is a perspective view of an embodiment of a portion of a heat sink used in the lamp of FIG. 1.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or submount is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "top" or "bottom" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter. The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a submount which may include sapphire, silicon, silicon carbide and/or other microelectronic submounts, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid state light emitters and/or multiple lumiphoric materials (i.e., in combination with at least one solid state light emitter) may be used in a single device, such as to produce light perceived as white or near white in character. In certain embodiments, the aggregated output of multiple solid-state light emitters and/or lumiphoric materials may generate warm white light output having a color temperature range of from about 2200K to about 6000K.

Solid state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials may be associated with a lumiphor, a lumiphor binding medium, or a lumiphor support element that may be spatially segregated from a solid state emitter.

Embodiments of the present invention provide a solid-state lamp with centralized light emitters, more specifically, LEDs. Multiple LEDs can be used together, forming an LED array. The LEDs can be mounted on or fixed within the lamp in various ways. In at least some example embodiments, a submount is used. The LEDs are disposed at or near the central portion of the structural envelope of the lamp. Since the LED array may be configured in some embodiments to reside centrally within the structural envelope of the lamp, a lamp can be constructed so that the light pattern is not adversely affected by the presence of a heat sink and/or mounting hardware, or by having to locate the LEDs close to the base of the lamp. It should also be noted that the term "lamp" is meant to encompass not only a solid-state replacement for a traditional incandescent bulb as illustrated herein, but also replacements for fluorescent bulbs, replacements for complete fixtures, and any type of light fixture that may be custom designed as a solid state fixture.

The figures show a lamp, 100, according to some embodiments of the present invention. Lamp 100 may be used as an A-series lamp with an Edison base 102, more particularly; lamp 100 is designed to serve as a solid-state replacement for an A19 incandescent bulb. While the lamp is disclosed as a replacement for an A19 bulb the lamp may be made equivalent to other standard bulbs such as A21, A23 or PAR standard bulbs, such as a replacement for a PAR-38, or BR standard bulbs or other standard or non-standard sizes. In some embodiments the lamp is an equivalent to a 100 watt incandescent bulb. While the lamp is disclosed as equivalent to a 100 Watt incandescent bulb the lamp may be made equivalent to other standard incandescent bulbs such as 40 watt, 60 watt or the like or the lamp may have a light out put that is different from standard incandescent bulbs. The lamp 100 is an omnidirectional lamp.

The Edison base 102 as shown and described herein may be implemented through the use of an Edison connector 103 and a form or housing 105. The lamp 100 comprises a solid-state lamp comprising multiple LEDs 127 used together, forming an LED array 130. The LEDs 127 can be mounted on or fixed within the lamp in various ways. The LEDs 127 in the LED array 130 may comprise an LED die disposed in an encapsulant such as silicone, and LEDs which are encapsulated with a phosphor to provide local wavelength conversion, as will be described later when various options for creating white light are discussed. A wide variety of LEDs and combinations of LEDs may be used including those described herein. The LEDs 127 of the LED array 130 are mounted on submounts 129 and are operable to emit light when energized through an electrical connection. In the present invention the term "submount" is used to refer to the support structure that supports the individual LEDs or LED packages 127 and in one embodiment comprises a printed circuit board or "PCB" although it may comprise other structures. In some embodiments, a driver and/or power supply may be included with the LED's on the submounts and may be formed by components on the submount.

Enclosure 112 is, in some embodiments, made of glass, quartz, borosilicate, silicate, polycarbonate, other plastic or other suitable material. The enclosure 112 may be at least partially transmissive and may be entirely optically transmissive such that light may be emitted from the lamp through the enclosure. The enclosure may be of similar shape to that commonly used in traditional incandescent bulbs. In some embodiments, the enclosure 112 is coated on the inside with silica, providing a diffuse scattering layer that produces a more uniform far field pattern. The enclosure may also be etched, frosted or coated. The diffuser may also be provided by the optical characteristics of the material of the enclosure itself such as where the enclosure is made of polycarbonate. Alternatively, the surface treatment may be omitted and a clear enclosure may be provided. The enclosure 112 may also be provided with a shatter proof or shatter resistant coating. In the illustrated embodiment the enclosure 112 is clear in order to show the internal components of the lamp. In use the enclosure 112 may comprise a diffuser such that the internal components may not be visible or may be only partially visible. It should also be noted that in this or any of the embodiments shown here, the optically transmissive enclosure or a portion of the optically transmissive enclosure could be coated or impregnated with phosphor.

A lamp base 102 such as an Edison base comprising an Edison screw 103 functions as the electrical connector to connect the lamp 100 to an electrical socket or other connector. Depending on the embodiment, other base configurations are possible to make the electrical connection such as other standard bases or non-traditional bases. Base 102 may retain, or partially retain, the electronics 110 for powering lamp 100 and may include a power supply and/or driver and form all or a portion of the electrical path between the mains and the LEDs. Base 102 may also include only part of the power supply circuitry while some smaller components reside on the submounts 129. The LEDs 127 of the LED array are operable to emit light when energized through an electrical connection. With the embodiment of FIG. 1, as with many other embodiments of the invention, the term "electrical path" can be used to refer to the entire electrical path to the LEDs 127, including an intervening power supply disposed between the electrical connection that would otherwise provide power directly to the LEDs and the LED array, or it may be used to refer to the connection between the mains and all the electronics in the lamp, including the power supply. The term may also be used to refer to the connection between the power supply and the LED array. Conductors 133 may be used to electrically connect the lamp electronics 110 to the LEDs 127 or electrically conductive substrates 129. The conductors 133 may comprise wires, ribbons, copper traces, conductive elements and/or other components.

In one example embodiment, the inductors and capacitor that form part of the EMI filter are in the Edison base. Suitable power supplies and drivers are described in U.S. patent application Ser. No. 13/462,388 filed on May 2, 2012 and titled "Driver Circuits for Dimmable Solid State Lighting Apparatus" which is incorporated herein by reference in its entirety; U.S. patent application Ser. No. 12/775,842 filed on May 7, 2010 and titled "AC Driven Solid State Lighting Apparatus with LED String Including Switched Segments" which is incorporated herein by reference in its entirety; U.S. patent application Ser. No. 13/192,755 filed Jul. 28, 2011 titled "Solid State Lighting Apparatus and Methods of Using Integrated Driver Circuitry" which is incorporated herein by reference in its entirety; U.S. patent application Ser. No. 13/339,974 filed Dec. 29, 2011 titled "Solid-State Lighting Apparatus and Methods Using Parallel-Connected Segment Bypass Circuits" which is incorporated herein by reference in its entirety; U.S. patent application Ser. No.

13/235,103 filed Sep. 16, 2011 titled "Solid-State Lighting Apparatus and Methods Using Energy Storage" which is incorporated herein by reference in its entirety; U.S. patent application Ser. No. 13/360,145 filed Jan. 27, 2012 titled "Solid State Lighting Apparatus and Methods of Forming" which is incorporated herein by reference in its entirety; U.S. patent application Ser. No. 13/338,095 filed Dec. 27, 2011 titled "Solid-State Lighting Apparatus Including an Energy Storage Module for Applying Power to a Light Source Element During Low Power Intervals and Methods of Operating the Same" which is incorporated herein by reference in its entirety; U.S. patent application Ser. No. 13/338,076 filed Dec. 27, 2011 titled "Solid-State Lighting Apparatus Including Current Diversion Controlled by Lighting Device Bias States and Current Limiting Using a Passive Electrical Component" which is incorporated herein by reference in its entirety; and U.S. patent application Ser. No. 13/405,891 filed Feb. 27, 2012 titled "Solid-State Lighting Apparatus and Methods Using Energy Storage" which is incorporated herein by reference in its entirety.

The AC to DC conversion may be provided by a boost topology to minimize losses and therefore maximize conversion efficiency. The boost supply is connected to high voltage LEDs operating at greater than 200V. Other embodiments are possible using different driver configurations or a boost supply at lower voltages.

The submounts 129 are arranged such that the LEDs 127 are positioned surrounding the longitudinal axis of the lamp and emit light generally toward the enclosure 112. The submounts 129 may comprise a PCB, FR4 board, metal core printed circuit board (MCPCB) or other similar structure. The submounts 129 may be made of a thermally conductive material. In some embodiments the thickness of the submounts may be about 1 mm-2.0 mm thick. For example the thickness may be about 1.6 mm. In other embodiments a copper or copper based lead frame may be used. Such a lead frame may have a thickness of about 0.25-1.0 mm, for example, 0.25 mm or 0.5 mm. In other embodiments, other dimensions including thicknesses are possible. In some embodiments the submounts 129 may be approximately 20 square mm. The entire area or substantially the entire area of the submounts 129 may be thermally conductive such that the submounts transfer heat to the heat sink 149. The submounts 129 comprise a first LED mounting portion 151 that functions to mechanically and electrically support the LEDs 127 and a second connector portion 153 that functions to provide thermal, mechanical and/or electrical connections to the heat sink 149 and the electrical path. The submounts may include circuitry and may be in the electrical path from the; lamp electronics to the LEDs. In one embodiment CREE XLamp Starboards may be used as the submounts 129. The submounts 129 may include a mounting structure such as receptacles 150 for receiving a fastener such as a screw that engage threaded holes on the heat sink structures 151 for securing the submounts 129 to the heat sink 149. In other embodiments other fastening mechanisms may be used including thermal adhesive, integrated mechanical mounting structures or the like.

In some embodiments, the LED lamp 100 is equivalent to a 100 Watt incandescent light bulb. Various embodiments of the LEDs usable in an equivalent 100 Watt lamp are shown in the following table:

| Sim # | Description | Fin Version | Secondary Heat Sink? | Orientation | Component | Total Power (W) | T i (° C.) |
|---|---|---|---|---|---|---|---|
| 1 | IPA_5_v3_mach_10-XML2 | 5_v3-machinable | No | Source Up | XM-L2 x10 | 21 | 106.4 |
| 2 | IPA_5_v3_mach_20-XTE | 5_v3-machinable | No | Source Up | XTE x20 | 21 | 102.7 |
| 3 | IPA_5_v3_mach_30-XQD | 5_v3-machinable | No | Source Up | XQD x30 | 21 | 102.8 |
| 4 | IPA_5_v4_mach-1mm_10-XML2 | 5_v4-thin-1mm | No | Source Up | XM-L2 x10 | 21 | 110.6 |
| 5 | IPA_5_v4_mach-2mm_10-XML2 | 5_v4-thin-2mm | No | Source Up | XM-L2 x10 | 21 | 105.1 |

For example, Sim #1 shows a lamp made with 10 XM-L2 LEDs sold by CREE INC. using the large heat sink 149 shown in FIGS. 1-4. No secondary heat sink is used. The LEDs are disposed in a facing up orientation with a total power of 21 W and a junction temperature of 106.4° C. Sims #2 and #3 show the same embodiment of the lamp using 20 CREE INC. XTE LEDs and 30 CREE INC. XQD LEDs, respectively. Sims #4 and #5 show the results for an embodiment of the lamp as shown in FIGS. 7-10 using 10 CREE INC. XM-L2 LEDs where the heat sinks have the thin configuration shown in FIGS. 8 and 10, rather than the relatively heavier and thicker configuration of the heat sink of FIGS. 1-4, where Sim #4 has a 1 mm thick heat sink and Sim #5 has a 2 mm thick heat sink.

The base 102 comprises an electrically conductive Edison screw 103 for connecting to an Edison socket and a housing portion 105 connected to the Edison screw. The Edison screw 103 may be connected to the housing portion 105 by threads, adhesive, mechanical connector, welding, separate fasteners or the like. The housing portion 105 may comprise an electrically insulating material such as plastic. Further, the material of the housing portion 105 may comprise a thermally conductive material such that the housing portion 105 may form part of the heat sink for dissipating heat from the lamp 100. The housing portion 105 and the Edison screw 103 define an internal cavity for receiving the electronics 110 of the lamp including the power supply and/or drivers or a portion of the electronics for the lamp. The lamp electronics 110 are electrically coupled to the Edison screw 103 such that the electrical connection may be made from the Edison screw 103 to the lamp electronics 110. The base 102 may be potted to physically and electrically isolate and protect the lamp electronics 110.

Figure 4:
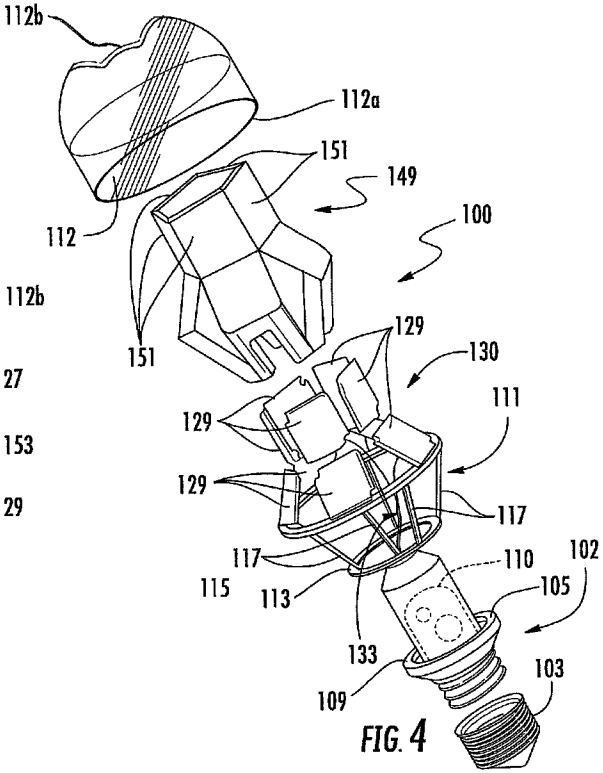
FIG. 4 is an exploded view of the lamp of FIG. 1.
Figure 3:
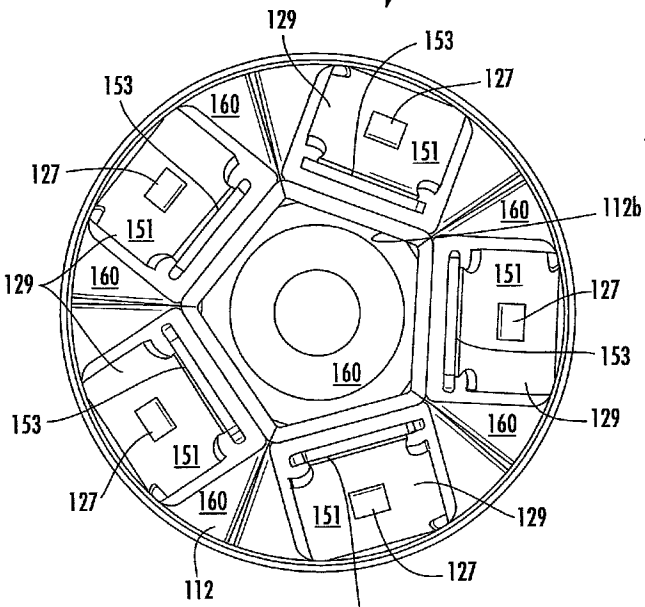
FIG. 3 is a top view of the lamp of FIG. 1.
Figure 6:
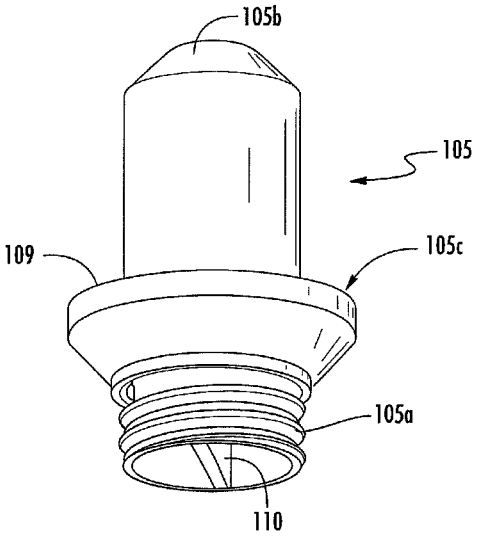
FIG. 6 is an embodiment of a housing used in the lamp of FIG. 1.
Figure 8:
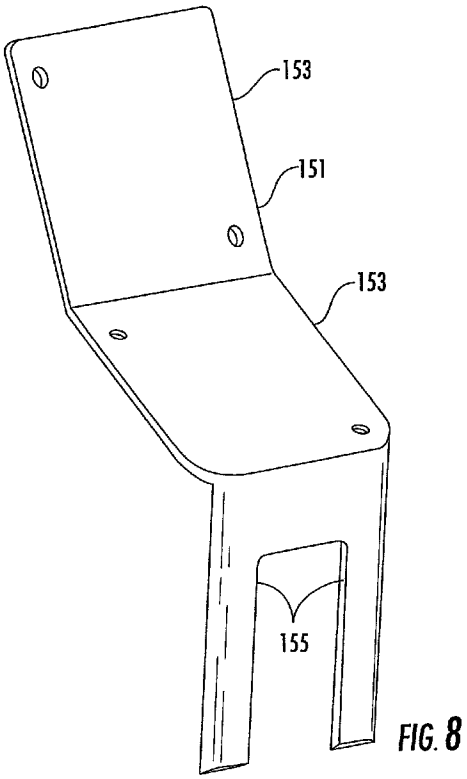
FIG. 8 is a perspective view of an embodiment of a portion of a heat sink used in the lamp of FIG. 7.
Figure 7:
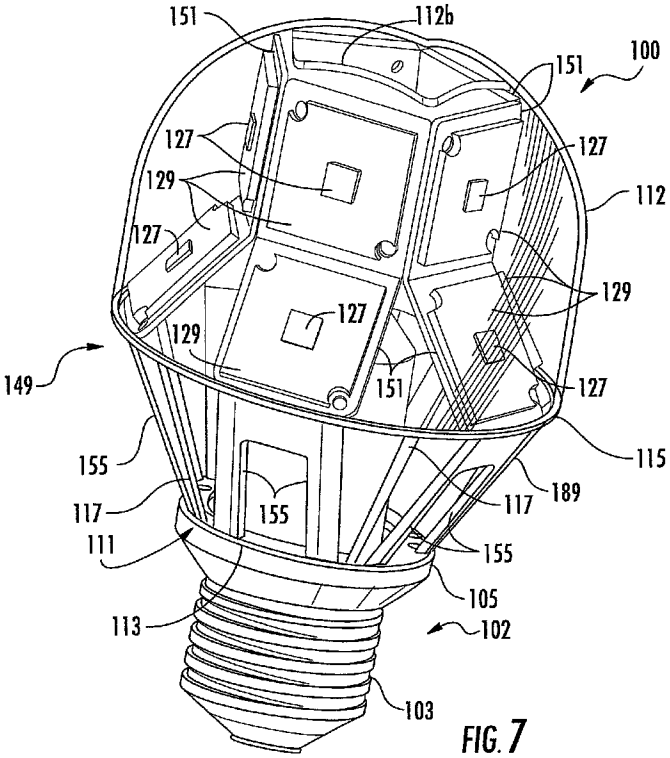
FIG. 7 is a perspective view of another embodiment of the lamp of the invention.
Figure 10:
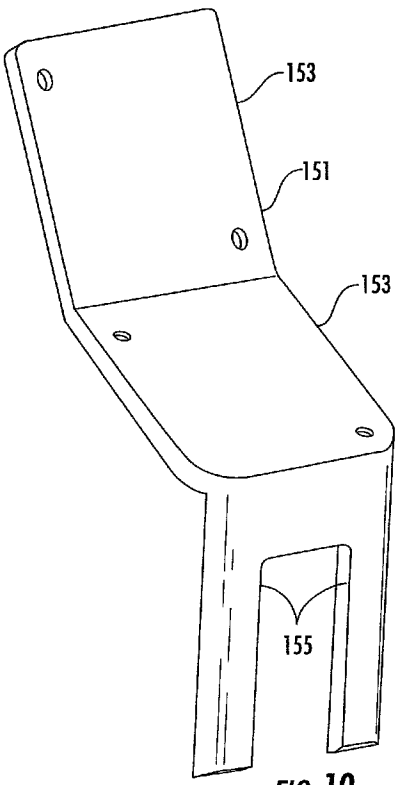
FIG. 10 is a perspective view of an embodiment of a portion of a heat sink used in the lamp of FIG. 9.
Figure 9:
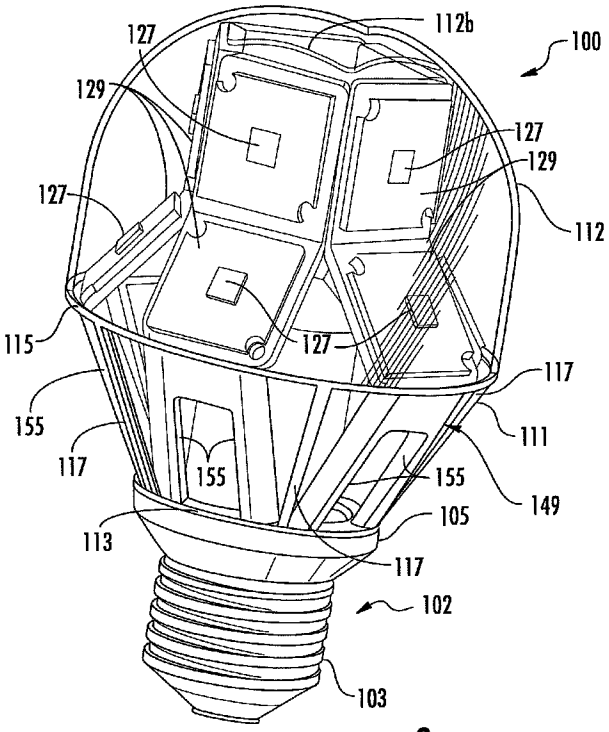
FIG. 9 is a perspective view of another embodiment of the lamp of the invention.

Referring to FIGS. 4 and 6, the housing 105 comprises a first portion 105*a* that is connected to the Edison screw 103 and a second portion 105*b* that extends into the LED assembly 130 and heat sink 149 and that retain some or all of the lamp electronics 110. A third portion 105*c* forms a support for supporting the LED assembly 130, heat sink 149 and enclosure 112 on the base 102. In one embodiment the base 102 and lamp have a generally cylindrical shape such that the support 105*c* is generally annular shape, however, the housing 105 and support 105*c* may have other shapes. Support 105*c* may be formed as a flange that extends from the base to form a support surface 109 for the LED assembly 130, heat sink 149 and enclosure 112. The housing 105 may have a diameter of approximately 21.5 mm and a length of approximately 60 mm.

Referring to FIG. 4, a support frame 111 is mounted on the housing 105 and may be mounted on support 105*c*. The frame 111 may be fixed to the support 105*c* by any suitable connection method such as screws, adhesive, welding or the like. In one embodiment, the frame 111 comprises a first annular connecting member 113 that is supported on support 105*c* and a second annular connecting member 115 that supports the open end 112*a* of enclosure 112. The first connecting member 113 and the second connecting member 115 are connected to one another by a plurality of spacers 117 such that the frame 111 has an open construction comprising openings between the connecting members 113, 115 and spacers 117 that allow access to the interior of the enclosure 112. The open end 112*a* of enclosure 112 may be connected to the second connecting member 115 by any suitable connection method such as screws, adhesive, welding or the like. While the housing 105, support 105*c*, member 113 and member 115, are described as annular, these members may have other shapes provided that they are able to adequately support enclosure 112 on base 102.

Figure 5:
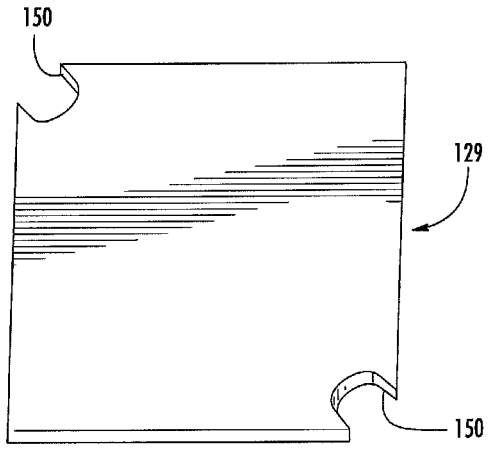
FIG. 5 is a plan view of an embodiment of a submount used in the lamp of FIG. 1.

The heat sink 149 may be mounted on the connecting member 113 such that the heat sink comprises a LED mounting portion that is disposed inside of enclosure 112 and a heat dissipating portion that is at least partially disposed in the openings defined by frame 111 such that the heat sink 149 is exposed to the exterior of the lamp and may conduct heat from the LEDs 127 to the exterior of the lamp. The heat sink 149 may comprise a plurality of separate heat sink structures 151 that are mounted to the frame 111 independently of one another. As shown, the heat sink 149 comprises a plurality of heat sink structures 151 each of which may support at least one LED 127. In the illustrated embodiments the heat sink structures 151 each support 2, 4 or 6 LEDs; however, each heat sink structure may support no LEDs or may support one or more LEDs in various combinations in addition to those shown in the figures. The heat sink structures 151 extend from inside of the enclosure 112 to the openings of frame 111 where they are exposed to the exterior of the lamp to conduct heat away from the LEDs to the exterior of the lamp. Because the heat sink structures 151 have a generally rectilinear profile and are arranged in a circular or cylindrical shape, passages 160 are formed between and behind the adjacent heat sink structures 151 that allow air to circulate from the ambient environment around the heat sink 149, submounts 129 and LEDs 127 and through the interior of the interior space of the heat sink. Each heat sink structure 151 may comprise one or more mounting surfaces 153 for mounting the submounts 129 such that the submounts are thermally coupled to the heat sink structures 151 0f the heat sink 149. The heat sink structures 151 also may comprise fin structures 155 that are located in the openings of frame 111 for dissipating heat to the ambient environment through the frame 111. The fin structures increase the surface area of the heat sink structures 151 to increase heat dissipation to the air. The fin structures also create openings that communicate with the openings in the frame 111 and that communicate with the interior space of the heat sink such that air may flow from the ambient environment through the heat sink. Heat is conducted from the LEDs 127 to the submounts 129 and from the submounts 129 to the heat sink 149 where the heat is dissipated to the ambient environment via the heat sink. The mounting surfaces 153 may comprise flat planar areas for receiving the submounts 129. The submounts 129 may be provided with corner cut outs 160 or apertures as shown in FIG. 5 for receiving screws or other fasteners for mounting the submounts 129 to the heat sink structures 151. The submounts 129 may also be mounted to the heat sink 149 using thermal epoxy, integrated mechanical connectors and/or other connection mechanisms or a combination of connection mechanisms. The enclosure 112 may be provided with an opening 112*b* that allows air flow through the distal end of the enclosure 112 through and around the heat sink 149 such that air may flow along the length of the heat sink between the base 102 and the distal end of the lamp.

The mounting surfaces 153 may be disposed on the heat sink 149 at a variety of angles relative to the longitudinal axis of the lamp such that the LEDs 127 mounted on mounting surfaces 153 may project light in any desired pattern such as an omnidirectional lamp as shown. The mounting surfaces may be disposed in 360 degrees about the longitudinal axis of the lamp such that a 360 degree light pattern is generated. The mounting surfaces 153 may be disposed at angles relative to the longitudinal axis of the lamp other than 90 degrees to project light laterally, toward the base 102 and/or toward the distal end of the lamp. As shown in the Figures each heat sink structure 151 comprises two mounting surfaces 153. The mounting surfaces positioned closer to the distal end of the lamp are disposed substantially parallel to the longitudinal axis of the lamp such that the light from LEDs 127 mounted on this surface is projected primarily laterally. The mounting surfaces positioned closer to the base of the lamp are disposed at an angle relative to the longitudinal axis of the lamp, between parallel and perpendicular, such that more of the light from an LED mounted on this surface is projected toward the distal end of the lamp. The angles of the mounting surfaces 153 may be varied to vary the light pattern emitted from the lamp. Further, while each heat sink structure 151 comprises two mounting surfaces 153 a greater or fewer number of mounting surfaces may be provided on each heat sink structure. Each mounting surface may also support more than one LED 127 and the types of LEDs supported on the mounting surfaces may be different. The heat sink structures 151 may include mounting surfaces that are disposed radially beyond the base 102 such that the base does not block light projected toward the base.

In one embodiment the heat sink structures 151 have a relatively thick construction where each heat sink structure is relatively heavy and provides a relatively large heat sink as shown in FIGS. 1-4. The heat sink structures may have a thickness of approximately 3 mm, 4 mm, and/or 5 mm and may be in the range of approximately 3-5 mm. Each heat sink structure 151 may have a weight of approximately 20-35 grams. In one embodiment each heat sink structure may have a weight of approximately 27.3 grams where a heat sink 149 having five heat sink structures 151, as shown, has a total weight of approximately 136.7 grams. The total weight of the heat sink may be approximately 110-170 grams. In other embodiments, the heat sink structures 151 may have a relatively thin walled construction where the structures may be on the order of approximately 1 mm thick (FIGS. 7 and 8) or approximately 2 mm thick (FIGS. 9 and 10) and may be in the range of approximately 1-3 mm thick. Such heat sink structures may have a weight of about approximately 3.8 grams for a 1 mm thick structure and a weight of approximately 7.7 grams for a 2 mm thick structure, for a total heat sink weight of 18.9 and 38.6 grams, respectively. Each heat sink structure 151 may have a weight of approximately 3.8-10 grams. The total weight of the heat sink with the thin heat sink structures may be approximately 15-50 grams. While specific embodiments of heat sink sizes and wall thicknesses are shown the heat sink may have thicknesses and weights other than those shown depending on the heat output by the LEDs and the thermal requirements of the LEDs and/or lamp. The heat sink 149 may be made of any suitable thermally conductive material or combination of materials such as aluminum, ceramic or the like. The heatsink structures 151 may be machined, cast, extruded or the like.

In one embodiment, a lamp constructed as described herein using a 3-5 mm thick heat sink with ten CREE XML-2 LEDS for 21 W total was shown to have a junction temperature of 106.4° C. In another embodiment a lamp constructed as described herein using a 3-5 mm thick heat sink with twenty CREE XT-E LEDS for 21 W total was shown to have a junction temperature of 102.7° C. In another embodiment a lamp constructed as described herein using a 3-5 mm thick heat sink with thirty CREE XQ-D LEDS for 21 W total was shown to have a junction temperature of 102.8° C. In yet another embodiment a lamp constructed as described herein using a 1 mm thick heat sink with ten CREE XML-2 LEDS for 21 W total was shown to have a junction temperature of 110.6° C. In still another embodiment a lamp constructed as described herein using a 2 mm thick heat sink with ten CREE XML-2 LEDS for 21 W total was shown to have a junction temperature of 105.1° C. In various embodiments of the invention different numbers and types of LEDs may be used. For example 15 CREE XP-G2 LEDS may be used, 20 CREE XT-E LEDs may be used, 10 CREE XM-L2 LEDs may be used or 30 CREE XQ-D LEDs may be used. The lamp has a total power of approximately 21 Watts and the junction temperature of the plurality of LEDs is between approximately 105 and 111° C.

Figure 11:
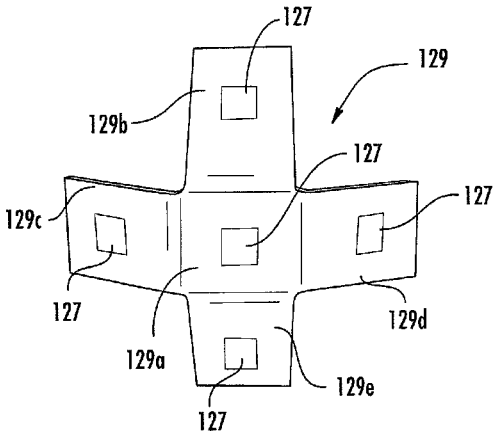
FIG. 11 is a perspective view of an embodiment of a bendable submount and LEDs usable in various embodiments of the lamp of the invention.

FIG. 11 shows an embodiment of a submount 129 where the submount is made of bendable substrate such as a metal core PCB (MCPCB). Using such a submount the LEDs 127 may be mounted on the submount 129 in a flat condition and the submount may be bent to fit on the heat sink 149 such that rather than having a separate submount on each mounting area 153 (as shown in the previous figures) a single submount may be used that spans multiple mounting areas 153. The submount may be folded or bent to locate the LEDs 127 on the mounting areas 153. One or more foldable submounts may be used with one or more heat sink structures and in various combinations. The MCPCB comprises a thermally and electrically conductive core made of aluminum or other similar pliable metal material. The core is covered by a dielectric material such as polyimide. Metal core boards allow traces to be formed therein. In one method, the core board is formed as a flat member and is bent into a suitable shape. Because the core board is made of thin bendable material and the anodes and cathodes may be positioned in a wide variety of locations, and the number of LED packages may vary, the metal core board may be configured such that it may be bent into a wide variety of shapes and configurations. The LEDs 127 are located on the flat sections such that the core board may be bent along the score lines to form the planar core board into a variety of three-dimensional shapes where the shape is selected to project a desired light pattern from the lamp 100. In one embodiment the MCPCB is formed of five LED supporting areas 129*a*-129*e* each supporting at least on LED 127. The MCPCB may have a central supporting area 129*a* from which four additional extension supporting areas 129*b*-129*e* extend. The center supporting area 129*a* may be formed as a rectangle where each of the four additional supporting areas 129*b*-129*e* extend from one side of the rectangle. The MCPCB may be bent such that the central supporting area 129*a* is horizontal in the lamp (horizontal meaning transverse to the longitudinal axis of the lamp) such that an LED 127 mounted on the central supporting area 129*a* may project the majority of its light out of the distal end of the enclosure 112. The four additional supporting areas 129*b*-129*e* may be disposed at an angle relative to the central supporting area such that the light from LEDs mounted on these areas is projected primarily laterally. The different supporting areas may be supported at a variety of angles to alter the light pattern emitted from the light. While five mounting areas are shown a greater or fewer number of mounting areas may be used and may be arranged in patterns other than that shown in the drawings. In another embodiment the central supporting area may be a pentagon where five additional extension supporting areas extend from the central supporting area. The MCPCB may be bent such that the five extensions are disposed on the five heat sink structures 151 and the central supporting area spans the space between the heat sink structures 151 and is disposed horizontally.

The LED assembly, whether made of a flexible submount such as a flexible PCB submount, a bendable MCPCB submount, a lead frame submount, a flex circuit, a hybrid combination of such submounts or the like, may be formed to have the configurations shown and described herein or other suitable three-dimensional geometric shape. A "three-dimensional" LED assembly as used herein and as shown in the drawings means an LED assembly where the submounts comprise mounting surfaces for different ones of the LEDs that are in different planes such that the LEDs mounted on those mounting surfaces are also oriented in different planes. In some embodiments the planes are arranged such that the LEDs are disposed over 360 degrees about the longitudinal axis of the lamp. Further when individual submounts 129 are used as shown, for example, in FIGS. 1-5, individual submounts are also disposed in a three-dimensional pattern Connectors or conductors in the form of circuitry on the substrates 129 such as traces connect to the anode and the cathode pairs of the LEDs to provide the electrical path to the anode/cathode pairs during operation of the LEDs. The submount 129 also comprises connector portion 153 that functions to couple the LED assembly 130 to the heat sink 149 such that heat may be dissipated from the LED assembly and to electrically couple the LED assembly 130 to the electrical path. An LED or LED package containing at least one LED 127 is secured to each anode and cathode pair where the LED/LED package spans the anode and cathode. The LEDs 127 may be attached to the submount by soldering.

In one embodiment of the lamp 100 the lamp has a lumen output of approximately at least 1600 lumens in a steady state operation where the LEDs reach an equilibrium temperature. The lamp may have a color rendering index (CRI) of approximately at least 80 with a correlated color temperature (CCT) of less than approximately 3000. The lamp 100 has an efficiency of at least approximately 80 lumens per Watt (LPW). These operating parameters are achieved without TIR optics. The operating parameters set forth above are for one design of the lamp of the invention; however, the lamp may be designed to meet other operating specifications for different types of lamps.

With respect to the features described herein with various example embodiments of a lamp, the features can be combined in various ways. For example, the various methods of including phosphor in the lamp can be combined and any of those methods can be combined with the use of various types of LED arrangements such as bare die vs. encapsulated or packaged LED devices. The embodiments described herein are examples only, shown and described to be illustrative of various design options for a lamp with an LED array.

LEDs and/or LED packages used with an embodiment of the invention and can include light emitting diode chips that emit hues of light that, when mixed, are perceived in combination as white light. Phosphors can be used as described to add yet other colors of light by wavelength conversion. For example, blue or violet LEDs can be used in the LED assembly of the lamp and the appropriate phosphor can be in any of the ways mentioned above. LED devices can be used with phosphorized coatings packaged locally with the LEDs or with a phosphor coating the LED die as previously described. For example, blue-shifted yellow (BSY) LED devices, which typically include a local phosphor, can be used with a red phosphor on or in the optically transmissive enclosure or inner envelope to create substantially white light, or combined with red emitting LED devices in the array to create substantially white light. Such embodiments can produce light with a CRI of at least 80, at least 90, or at least 95. By use of the term substantially white light, one could be referring to a chromacity diagram including a blackbody 160 locus of points, where the point for the source falls within four, six or ten MacAdam ellipses of any point in the blackbody 160 locus of points.

A lighting system using the combination of BSY and red LED devices referred to above to make substantially white light can be referred to as a BSY plus red or "BSY+R" system. In such a system, the LED devices used include LEDs operable to emit light of two different colors. In one example embodiment, the LED devices include a group of LEDs, wherein each LED, if and when illuminated, emits light having dominant wavelength from 440 to 480 nm. The LED devices include another group of LEDs, wherein each LED, if and when illuminated, emits light having a dominant wavelength from 605 to 630 nm. A phosphor can be used that, when excited, emits light having a dominant wavelength from 560 to 580 nm, so as to form a blue-shifted-yellow light with light from the former LED devices. In another example embodiment, one group of LEDs emits light having a dominant wavelength of from 435 to 490 nm and the other group emits light having a dominant wavelength of from 600 to 640 nm. The phosphor, when excited, emits light having a dominant wavelength of from 540 to 585 nm. A further detailed example of using groups of LEDs emitting light of different wavelengths to produce substantially while light can be found in issued U.S. Pat. No. 7,213,940, which is incorporated herein by reference.

Different embodiments of the LED assembly and heat sink are possible. In various embodiments, the heat sink 149 may be relatively shorter, longer, wider or thinner than that shown in the illustrated embodiment. Moreover the LED assembly may engage the heat sink 149 and lamp electronics 110 in a variety of manners. For example, the heat sink may only comprise the heat dissipating portions 155 and the LED mounting areas 153 may be integrated with the LED assembly 130 such that the integrated heat sink mounting areas and LED assembly engage the heat dissipating portion 155. In some embodiments, the LED assembly and heat sink may be integrated into a single piece or be multiple pieces other than as specifically shown.

Once the LEDs 127 and submounts 129 are mounted on the heat sink structures 151, the heat sink structures may be attached to the base 102 and/or frame 111 such as by using screws, adhesive, welding or the like. The enclosure 112 may be attached to the frame 111. In one embodiment, the LED assembly 130 and the heat sink 149 are inserted into the enclosure 112 through the neck 112*a*. The neck 112*a* and frame 111 are dimensioned and configured such that the rim 112*a* of the enclosure 112 sits on the upper support 115 of the frame 111 with the heat dissipating portions 155 disposed at least partially outside of the enclosure 112, in the open areas of frame 111. To secure these components together a bead of adhesive may be applied to the upper support 115 of the frame 111. The rim of the enclosure 112 may be brought into contact with the bead of adhesive to secure the enclosure 112 to the frame 111 to complete the lamp assembly.

In some embodiments the form factor of the lamp is configured to fit within the existing standard for a lamp such as the A19 ANSI standard. Moreover, in some embodiments the size, shape and form of the LED lamp may be similar to the size, shape and form of traditional incandescent bulbs. The LED lamp of the invention is designed to provide desired performance characteristics while having the size, shape and form of a traditional incandescent bulb.

Although specific embodiments have been shown and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A LED lamp comprising:

a base;

an at least partially optically transmissive enclosure connected to the base defining a longitudinal axis of the lamp extending from the base to the enclosure;

a frame comprising a first end connected to the base and a second end connected to the enclosure, the frame narrowing from the second end to the first end and comprising openings for allowing access to the interior of the enclosure;

a heat sink partially disposed in the enclosure and supporting a plurality of LEDs operable to emit light when energized where the interior of the enclosure is exposed to the ambient environment, the heat sink comprising a plurality of separate heat sink structures that are mounted to the lamp independently of one another, wherein each of the plurality of heat sink structures comprises a mounting portion positioned in the enclosure for supporting the LEDs and a heat dissipating portion located outside of the enclosure and exposed to the ambient environment, the mounting portion comprising a first mounting surface supporting at least one first LED of the plurality of LEDs and a second mounting surface supporting at least one second LED of the plurality of LEDs, the first mounting surface being disposed parallel to the longitudinal axis of the lamp and and a second end spaced from the first mounting surface, the second mounting surface extending away from the longitudinal axis from the first end to the second end such that the second mounting surface is disposed at an included angle with the first mounting surface of less than 180 degrees where the second end of the second mounting surface extends from the longitudinal axis a first distance and the heat dissipating portion extends from adjacent the second end of the second mounting surface to the first end where the first end extends from the longitudinal axis a second distance where the first distance is greater than the second distance such that the heat dissipating portion narrows as the heat dissipating portion extends from the second mounting surface to the first end, the heat dissipating portion being at least partially disposed in the openings and extending from the first end to the second end.

2. The lamp of claim 1 wherein the lamp has a color rendering index of approximately at least 80 with a correlated color temperature (CCT) of less than approximately 3000.

3. The lamp of claim 1 wherein the base comprises an Edison base.

4. The lamp of claim 1 wherein the plurality of LEDs are mounted on at least one thermally conductive submount.

5. The lamp of claim 4 wherein the at least one submount is arranged such that the plurality of LEDs surround a longitudinal axis of the lamp and emit light generally toward the enclosure.

6. The lamp of claim 4 wherein the at least one submount comprises at least one of a PCB, metal core printed circuit board, FR4 board, lead frame or flex circuit.

7. The lamp of claim 4 wherein the at least one submount is bent into a three-dimensional shape.

8. The lamp of claim 4 wherein the at least one submount is approximately 20 square mm.

9. The lamp of claim 1 wherein lamp electronics are in the electrical path and are contained in a housing comprising a first portion that is connected to the base and a second portion that extends into the heat sink.

10. The lamp of claim 1 comprising an opening in the enclosure that communicates the interior of the enclosure with the exterior of the lamp.

11. The lamp of claim 1 wherein each of the plurality of heat sink structures comprises a fin structure that is exposed to the exterior of the lamp.

12. The lamp of claim 1 comprising at least one passage formed adjacent the plurality of heat sink structures that allow air to circulate from the ambient environment around the heat sink.

13. The lamp of claim 1 wherein each of the plurality of heat sink structures having a thickness of approximately 3 to 5 mm and each of the plurality of heat sink structures weigh approximately 20 and 35 grams such that the heat sink has a total weight of approximately 110 to 170 grams, wherein the lamp has a lumen output of approximately at least 1600 lumens in a steady state operation and an efficiency of at least approximately 80 lumens per Watt (LPW) with a total power of approximately 21 Watts and a junction temperature of the plurality of LEDs between approximately 105 and 111° C.

14. The lamp of claim 1 wherein each of the plurality of heat sink structures have a thickness of approximately 1 to 3 mm and each of the plurality of heat sink structures weigh approximately 3.8 to 10.0 grams each such that the heat sink has a total weight of approximately 15 to 50 grams, wherein the lamp has a lumen output of approximately at least 1600 lumens in a steady state operation and an efficiency of at least approximately 80 lumens per Watt (LPW) with a total power of approximately 21 Watts and a junction temperature of the plurality of LEDs between approximately 105 and 111° C.

15. The lamp of claim 1 wherein the first mounting surface extends from a first side of the second mounting surface and the heat dissipating portions extend from a second side of the second mounting surface.

16. The lamp of claim 12 wherein the heat sink structures comprise heat dissipating portions that are at least partially disposed in the openings.

* * * * *